US005519369A

United States Patent [19]

Hendel

[11] Patent Number: 5,519,369

[45] Date of Patent: May 21, 1996

[54] ELECTROMAGNET SYSTEM AND A METHOD AND DEVICE FOR JOINING THE CORE AND YOKE IN THE CASE OF THE ELECTROMAGNET SYSTEM

[75] Inventor: Horst Hendel, Berlin, Germany

[73] Assignee: Siemens Aktiengellschaft, Munich, Germany

[21] Appl. No.: 178,286

[22] PCT Filed: Jun. 22, 1992

[86] PCT No.: PCT/DE92/00512

§ 371 Date: Jan. 10, 1994

§ 102(e) Date: Jan. 10, 1994

[87] PCT Pub. No.: WO93/01607

PCT Pub. Date: Jan. 21, 1993

[30] Foreign Application Priority Data

Jul. 9, 1991 [DE] Germany ..... 41 22 705.0

[51] Int. Cl.[6] ..... H01H 51/22

[52] U.S. Cl. ..... 335/85; 335/250

[58] Field of Search ..... 335/78–86, 250, 335/251, 281

[56] References Cited

U.S. PATENT DOCUMENTS

| | | | |
|---|---|---|---|
| 2,735,047 | 2/1956 | Garner et al. | 335/251 |
| 4,109,221 | 8/1978 | Pauli | 335/251 |
| 4,720,909 | 1/1988 | Knight et al. . | |
| 4,749,977 | 6/1988 | Prouty et al. | 335/281 |

FOREIGN PATENT DOCUMENTS 3148052 6/1983 Germany .

*Primary Examiner*—Lincoln Donovan
*Attorney, Agent, or Firm*—Hill, Steadman & Simpson

[57] ABSTRACT

The electromagnet system has a bent yoke and a round core which has a constant cross-section from a pole end towards a mounting end, and the core has an outwardly expanded tapered section at the mounting end. The core is inserted from the outside into a hole in the yoke, with the pole end being first, and the core is adjusted and fixed by means of pulse-like shocks. Thus, the core is joined to the yoke by a force fit which is a uniformly reliable firm seat.

16 Claims, 2 Drawing Sheets

ELECTROMAGNET SYSTEM AND A METHOD AND DEVICE FOR JOINING THE CORE AND YOKE IN THE CASE OF THE ELECTROMAGNET SYSTEM

BACKGROUND OF THE INVENTION

The invention relates to an electromagnet system, preferably for a relay, having a bent yoke and having a core which, with one pole end, is opposite an armature and is mounted, by means of one mounting end, with a push fit in a hole in a yoke limb. In addition, the invention relates to a method and to a device for joining the core and yoke together in the case or housing of this electromagnet system.

Electromagnet systems having a winding which is located on a coil former, a core which runs axially through the coil former and a bent yoke which surrounds the coil on two outer sides are generally known and normal. In this case, the core is as a rule pressed with its mounting end in front from the pole side through the coil former into the hole in the yoke limb and, under some circumstances, is fixed by additional measures, such as clipping or welding, to the outside of the yoke. This insertion direction is necessary in the case of most magnet systems since, in order to increase the pole area, the core has an enlarged cross-section at the one pole end, and because of the enlarged cross-section the core would not be possible for it to be pushed in from the yoke side. This conventional type of core mounting is also expedient when the coil former opening is in any case accessible from the pole side or armature side. However, in these cases, the armature cannot be attached until the core has been pushed in, since it is necessary to carry out an adjustment of the pole surface, for example flush with the bearing edge of the yoke, before the insertion of the armature as a rule. Adjustment of the operating air gap, which is desired after installation of the armature, can as a rule be carried out only under more difficult conditions, by displacement of the core.

From U.S. Pat. No. 4,720,909, a method for pressing a core into a yoke hole is already known, and the patent discloses an annular bead which surrounds the hole initially being integrally formed on the yoke limb, so that the mounting path between the yoke limb and the core is extended. The document has also already described the design of the core to be slightly conical towards the mounting end, to be precise in the sense of a cross-section which reduces towards the end, in order to simplify the insertion into the yoke hole. However, in this case as well, the insertion must take place from the pole side, since the core has a pole plate of an enlarged cross-section at the end of the pole side.

However, for various applications it is structurally impossible to insert the core from the armature side or pole side, for example if the armature is, for specific reasons, intended to be installed before the core or if two magnet systems are intended to be mounted on a common base body, aligned with one another, with a short distance between the two cores. For such cases, it is already known from DE-A 3,148,052 for the coil core to be inserted from the yoke limb side and then to be screwed into a specific dimension or position, with the aid of a fine thread. However, the provisions of fine mounting threads between the core and the yoke demands considerable complexity both in the production of the components and in the installation and adjustment.

SUMMARY OF THE INVENTION

The object of the invention is to create a magnet system of the type mentioned initially, in the case of which the core can be inserted through the hole in the yoke limb, 30 and can be mounted reliably and securely in precise positions or dimensions, in a simple manner. In addition, the invention is directed to a method for joining the core and yoke, and a device which is suitable for this purpose.

According to the invention, an electromagnet system for achieving this object is characterized in that the core, from its pole end to the vicinity of the mounting end, has a constant cross-section, which can be plugged or passed through the hole in the yoke limb, and the core has a conically expanded tapered section towards its mounting end so that, at the mounting end, the core has a core diameter which exceeds the hole diameter in the yoke.

In the case of the electromagnet system according to the invention, the core is thus conically expanded at its mounting end, in contrast to known designs, so that the core can initially be inserted with the pole end first from the outside through the hole in the yoke limb, and possibly through a coil former, and so that engagement of the outer surface of the core with the inner diameter of the hole in the yoke does not take place until the end of the insertion movement. The conical design of the core end results in a very good firm seat of the core in the yoke with an improved force-fit and positive lock and with improved positioning accuracy of both parts. Since this core can be pushed in from the yoke side, the yoke can, for example, be preinstalled with the armature, before the core is inserted. For the firm seat, the mounting end of the core with the cone is preferably dimensioned such that the pressing-out force of the core is approximately ⅔ of the pressing-in force. The tapered section preferably has a gradient of approximately 1° to 2° with respect to the coil axis, and the gradient is preferably 1.5°. The maximum diameter of the core at the mounting end is, in the case of normal relay magnet systems, approximately 5 to 10% larger than the diameter of the core in the constant diameter region and 3 to 5% larger than the diameter of the yoke hole; specially in order to simplify insertion, the constant diameter region of the core is somewhat smaller in diameter than the yoke hole. For a coil core having a diameter of, for example, 6 mm, this thus results in the core being oversize with respect to the yoke hole by approximately 0.2 to 0.3 mm.

The method according to the invention for joining the core and yoke together for the electromagnet system, has the core being plugged or inserted through a hole in a yoke limb and being fixed by the mounting end being pressed in, is characterized in that a tapered section which expands towards the mounting end is integrally formed on the core, which is of constant thickness over a considerable part of its length and fits through the hole in the yoke limb, the diameter of the tapered section is larger at the mounting end than the diameter of the hole, in that the core is inserted with its pole end being first through the hole in the yoke limb, and in that the core is moved into its final position by a pulse-like force acting on the mounting end. As the result of this method according to the invention, the core is initially pushed in through the yoke hole and, possibly, a coil former hole from the yoke rear side with little force. Increased use of force is not necessary until the conically expanded mounting end enters the yoke hole, the push fit being increased by the core being driven in a pulsed manner. The wedging effect of the tapered section produces a high surface pressure so that the firm seat and the magnetic coupling between the two parts achieve very high levels.

In contrast to normal movement-controlled pressing-in stamps, only kinetic energy is used in this case which is produced, for example, by a plunger which is accelerated to a suitable speed and strikes against the core. As a result of the high surface pressure, a multiplication of the initial strength between the core and the yoke is produced after some time, which is caused by a cold-flowing movement of the surfaces which pass through one another. The strength can be further improved by the influence of heat over a period of, for example, one hour. In this case, the strength is improved with higher temperatures, and the upper temperature limit is approximately 200° C., as a rule, because of the plastic coil former. The strength against the core being forced or levered out of the yoke is also improved, since the tapered core fills the hole over the entire thickness of the yoke without gaps.

The method according to the invention for the pulse-like use of force requires no opposing support of the relay construction while the core is being pushed into its final position, since the opposing force is actually produced by the inertia of the yoke and, possibly, of the copper winding of the coil. In this case, it is sufficient for the relay to beheld in a relatively inaccurate position such that it can pivot, in order to absorb the small vibrations caused by the influence of the force pulses. The movement displacement of the core which can be achieved in each case per force pulse can be changed over a wide range via the intensity of the pulses, so that good positioning accuracy of the core with respect to the yoke and with respect to the coil former can be achieved.

An advantageous device for joining the core and yoke in accordance with the method according to the invention has a holder in the form of tongs which can hold the magnet system and can pivot freely about an axis which is at right angles to the direction of the coil axis, and has an impact device having a plunger which can be driven in a pulsed manner and can be set such that it acts axially on the mounting end of the core.

The invention is explained in more detail in the following text using exemplary embodiments and with reference to the drawings.

DESCRIPTION OF THE PREFERRED EMBODIMENT

Figure 1:
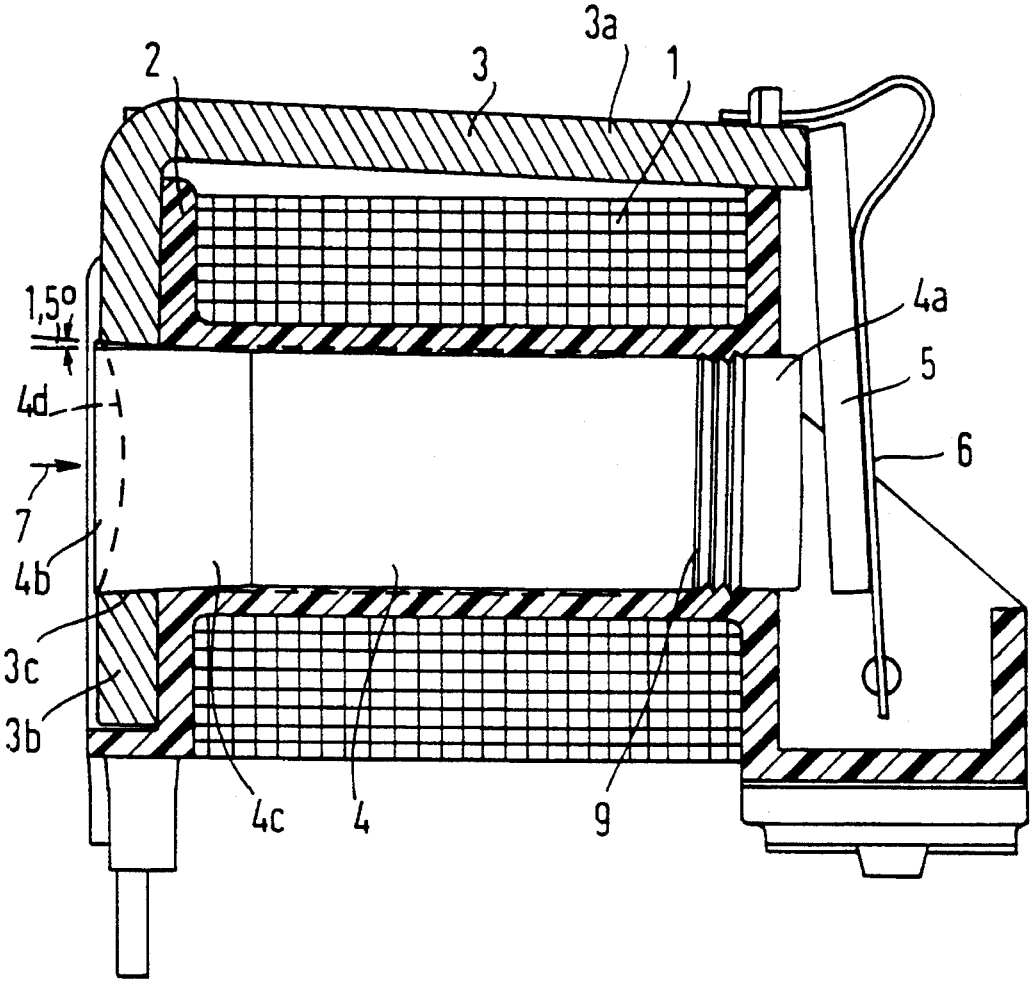
FIG. 1 is a cross-sectional view of a relay magnet system having a coil core which is designed and installed according to the invention.

The magnet system which is shown in FIG. 1 for a relay has a winding 1 on a coil former 2, and a bent yoke 3. The yoke 3 has a first yoke limb 3*a*, which is bent approximately parallel to the coil axis, and has a second yoke limb 3*b*, which runs at right angles to the coil axis. A core 4 is inserted or plugged through the second yoke limb 3*b* and through the axial hole, passage or recess in the coil former 2, which core 4 faces an armature 5 with one pole end 4*a* and is held in a force-fitting manner, by means of a mounting end 4*b*, in a hole 3*c* in the yoke limb 3*b*. The armature 5 is held by a leaf spring 6, which is shown only schematically and is at the same time used as a contact spring. This contact spring interacts with mating contact elements, which are not shown and are not installed until after the assembly of the magnet system.

Over the majority of its length including the pole end 4*a*, the core 4 has a constant round cross-section which is somewhat smaller than the hole 3*c* in the yoke limb 3*b*. A tapered section 4*c*, which expands conically towards the mounting end with a gradient of approximately 1.5°, is integrally formed only in the region of the mounting end 4*b*.

During installation, the core 4 is initially inserted, with its pole end 4*a* in front or first, in the direction of the arrow 7 into the hole 3*c* in the yoke limb 3*b*, and is then inserted through the inner hole in the coil former 2, with little force being required initially. Somewhat higher joining forces are not required until the tapered section 4*c* comes into contact with the yoke limb 3*b*. These joining forces are applied in a pulsed manner onto the mounting end 4*b*, using a plunger 8 (see FIG. 2). In this case, the plunger can strike in a cup-shaped depression 4*d* of the core, which at the same time represents a marking for the mounting end of the core, since the conical expansion at this end is so small that it cannot directly be identified using the naked eye. In the vicinity of the pole end 4*a*, the core additionally has tab-like or rib-like projections 9 which provide security between the core and coil former against axial displacement.

Figure 2:
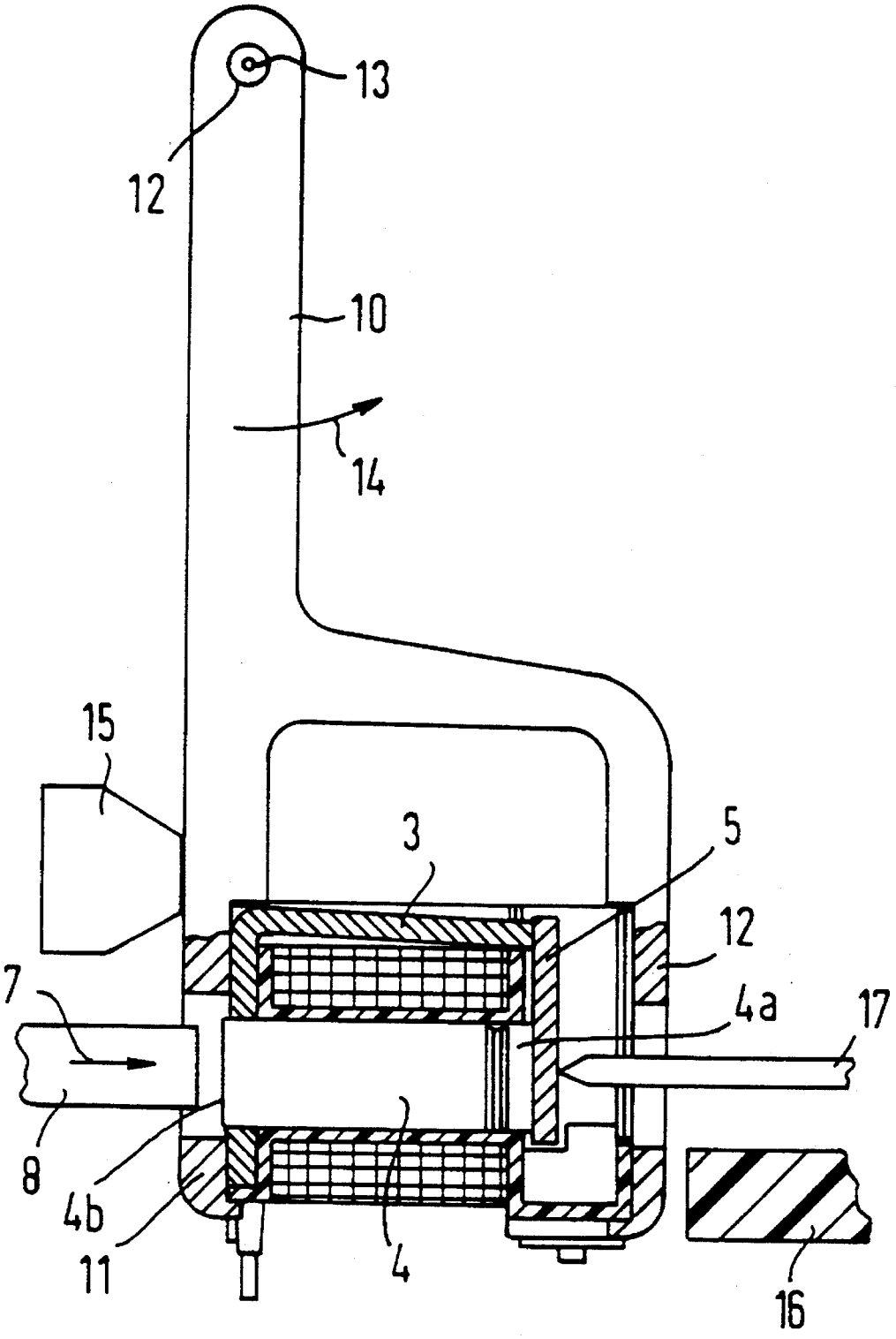
FIG. 2 is a schematic side view with portions in cross section of a device for carrying out the method according to the invention.

FIG. 2 shows schematically a device for joining the core and yoke for a magnet system according to FIG. 1. In this case, the magnet system for FIG. 1 is held, with the armature 5 already preinstalled, in a retaining device 10, in the form of tongs, between two jaws 11 and 12 so that the coil axis is horizontal when the retaining device 10 is supported by a bearing 12 so that it can pivot about a rotation axis 13 which is at right angles to the axial direction of the coil. A plunger 8, which can be operated in a pulsed manner in the direction of the arrow 7 by means of a drive device which is not shown, applies a force pulse to the mounting end 4*b* of the core 4 whenever the drive device is energized, so that it is possible for the magnet system to pivot or swing with the retaining device 10 to pivot or swing in the direction of the arrow 14. When the system has pivoted back and is resting on the rest stop 15, the next force pulse can be applied.

In order to damp the oscillation of the magnet system with the retaining device 10, a damping element 16 can be provided which limits the deflection of the system and damps the oscillation. The actual opposing force is, however, produced by the inertia of the yoke and of the coil. If the damping device is suitably designed, the coil axis and the rotation axis need not necessarily lie horizontally but can occupy any other desired positions in three-dimensions.

In each case after one or more force pulses, the position of the pole end 4*a* of the core and of the armature 5 which rests on the pole end can be measured using a measurement probe 17. Depending on the measurement result, the core can be knocked further into the yoke, using further force pulses of the same or different intensities.

I claim:

1. An electromagnet system having a bent yoke and having a core which has one pole end opposite an armature and one mounting end, said core being mounted on a yoke limb by means of the one mounting end having a push fit in a hole in the yoke limb, the improvement comprising the core from the pole end to the vicinity of the mounting end having a constant cross-section region with a diameter, which can be inserted through the hole in the yoke limb, and the core having a conically expanded tapered section towards the mounting end with a maximum diameter which exceeds the hole diameter to form the push fit with the hole in the yoke.

2. The magnet system as claimed in claim 1, wherein the tapered section has a gradient of 1° to 2° with respect to the coil axis.

3. The magnet system as claimed in claim 1 wherein the maximum diameter of the core at the mounting end is approximately 5 to 10% larger than the diameter in the constant cross-section region, and is 3 to 5% larger than the diameter of the yoke hole.

4. The magnet system as claimed in claim 1, wherein the mounting end of the core has a marking at the end.

5. The magnet system as claimed in claim 1, wherein in the vicinity of the pole end, the core has retaining elements on an outer surface, which elements interlock with the material of a coil former and prevent relative axial displacement between the core and coil former.

6. A method for joining a core and a yoke together for an electromagnet system, said yoke having a limb with a hole receiving an mounting end of the core with a push fit, said core having a constant cross-section region extending from a pole end to adjacent the mounting end which region can be inserted through the hole, the mounting end having a conically expanded tapered section with a maximum diameter which exceeds the hole diameter, said method comprising the steps of inserting the core with the pole end first into the hole of the yoke limb and as the mounting end engages the walls of the hole pressing the tapered section of the mounting end into the hole with a pulse-like force action on the mounting end.

7. The method as claimed in claim 6, wherein the tapered section is dimensioned with respect to the hole so that the pressing-out force of the core is approximately ⅔ of the pressing-in force.

8. The method as claimed in claim 6, wherein the return of the magnet system to its original position is waited for before the next force pulse in each case.

9. The method as claimed in claim 6, wherein the magnet system is suspended so that it can pivot freely about a horizontal axis, which is at right angles to the axial direction of a coil access, while the pulse-like force is being applied.

10. The method as claimed in claim 6, wherein the deflection of the magnet system after the force pulses is in each case damped by additional measures.

11. A device for joining a core and yoke of a magnet system by a method of inserting a pole end of the core first through a hole in the yoke and applying a pulse-like force to a mounting end of the core which has an enlarged conical taper to force the mounting end into the hole with a force fit, said device including retaining means in the form of tongs for holding the magnet system, said retaining means being mounted for pivotable movement around an axis which extends at right angles to an axis of the core, and an impact device having a plunger which can be driven in a pulsed manner and can be set so that the plunger acts axially on the mounting end of the core.

12. The device as claimed in claim 11, which includes by a damping device which reduces oscillations of the magnet system in the impact direction.

13. The device as claimed in claim 11, which includes a measuring device which optionally probes the pole end of the core, indirectly or directly.

14. A magnet system according to claim 5, wherein the tapered section has a gradient of 1.5° with respect to the coil axis, the retaining elements are retaining tabs and the mounting end of the core has a marking at the end formed by a cup-shaped depression.

15. The method as claimed in claim 6, wherein the force is applied to the mounting end without a rigid opposing bearing for the magnet system.

16. The device as claimed in claim 11, wherein the intensity of the force pulses which can be produced using the plunger can be adjusted.

* * * * *